US008246040B2

(12) United States Patent
Suzuki

(10) Patent No.: US 8,246,040 B2
(45) Date of Patent: Aug. 21, 2012

(54) SHEET FEEDING APPARATUS AND IMAGE FORMING APPARATUS

(75) Inventor: Tomoo Suzuki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/810,827

(22) PCT Filed: Aug. 17, 2009

(86) PCT No.: PCT/JP2009/064385

§ 371 (c)(1),
(2), (4) Date: Jun. 25, 2010

(87) PCT Pub. No.: WO2010/026866

PCT Pub. Date: Mar. 11, 2010

(65) Prior Publication Data

US 2011/0140345 A1 Jun. 16, 2011

(30) Foreign Application Priority Data

Sep. 5, 2008 (JP) ..... 2008-228065

(51) Int. Cl.
*B65H 3/14* (2006.01)

(52) U.S. Cl. ..... 271/98; 271/152

(58) Field of Classification Search ..... 271/97, 271/98, 152, 154, 155

See application file for complete search history.

(56) References Cited

U.S. PATENT DOCUMENTS

| | | | | |
|---|---|---|---|---|
| 4,801,135 | A * | 1/1989 | Povio | 271/155 |
| 7,267,337 | B2 * | 9/2007 | Moore et al. | 271/148 |
| 2008/0277862 | A1 * | 11/2008 | Koga et al. | 271/97 |

FOREIGN PATENT DOCUMENTS

| | | |
|---|---|---|
| JP | 2000-500422 | 1/2000 |
| JP | 2000-309431 | 11/2000 |
| JP | 2004-142881 | 5/2004 |
| JP | 2005-162419 | 6/2005 |
| JP | 2006-021867 | 1/2006 |
| JP | 2006-027797 | 2/2006 |
| JP | 2006-160482 | 6/2006 |
| WO | WO 97/19011 | 5/1997 |

OTHER PUBLICATIONS

English-language International Search Report from the Japanese Patent Office mailed Sep. 8, 2009, for International Application No. PCT/JP2009/064385.

Office Action issued from the Chinese Patent Office in counterpart Chinese patent application No. 200980101530.2, mailed Apr. 23, 2012 (5 pages).

* cited by examiner

*Primary Examiner* — Michael McCullough

(74) *Attorney, Agent, or Firm* — Finnegan, Henderson, Farabow, Garrett & Dunner, L.L.P.

(57) ABSTRACT

A sheet feeding apparatus is constituted from a sheet loading section having a raising and lowering plate, sheet side surface regulating members that regulate side surfaces of sheets, and an air blowing section that blows air towards the side surface of sheets in a top part, a sheet suction and conveying section, a reflection type sensor which detects the upper limit position of the sheets in the sheet loading section, a control section which, when an output of the reflection type sensor becomes an output indicating the state between the sheets that are put in the floating state due to the air flow blown out from an air blowing section and the sheets that are maintaining the stacked state, carries out control so as to raise the raising and lowering plate.

4 Claims, 4 Drawing Sheets

SHEET FEEDING APPARATUS AND IMAGE FORMING APPARATUS

CROSS-REFERENCE TO RELATED APPLICATIONS

This application is a U.S. National Phase Application under 35 USC 371 of International Application No. PCT/JP2009/064385, filed Aug. 17, 2009, which claims the priority of Japanese Patent Application No. 2008-228065, filed Sep. 5, 2008, the content of both of which is incorporated herein by reference.

TECHNICAL FIELD OF THE INVENTION

The present invention relates to sheet feeding apparatuses that suck and convey a sheet shaped paper by a sheet sucking and conveying section from above a stack of sheets stored and stacked in a sheet storing section, and to image forming apparatuses such as copying machines, printers, facsimile machines, etc., that are provided with such a sheet feeding apparatus.

PRIOR ART

Image forming apparatuses are well known that not only form toner images on an image carrier according to an original document or image data by carrying out charging, exposure, and development processing, but also, carry out fixing operation after transferring that toner image onto a sheet either directly or via an intermediate image transfer member.

In such an image forming apparatus is provided a sheet feeding apparatus having a sheet storing section in which sheet shaped paper can be stacked and stored, and a sheet feeding section that feeds one sheet at a time from the sheets inside that sheet storing section.

The sheet feeding apparatus, as a sheet feeding section, can be of the roller type, or of the so called suction type which not only sucks and holds a sheet on a suction belt using negative pressure, but also feeds the sheet in a prescribed direction.

A suction type sheet feeding apparatus adopts a construction of taking the top sheet in a stack of sheets to the floating condition.

A sheet feeding apparatus according to the present invention belongs to the latter suction type.

As a sheet feeding apparatus having a sheet feeding section of this suction type, for example, a sheet feeding apparatus having the following construction has been proposed.

In other words, a sheet storing section is provided with a sheet loading section, a sheet sucking and conveying section, and a sheet separating section for separating sheets, etc., and a height detection sensor and a height detection sensor lever are provided in the sheet loading section.

The height detection sensor and the height detection sensor lever are the ones that detect the height of the top surface of the stack of sheets stacked in the tray.

Putting it in other words, the height detection sensor lever operates according to the position of the height of the top surface of the sheets, and detection whether or not the top surface of the sheets has reached a prescribed position is made by the height detection sensor detecting the condition of its operation.

The result of detection by the height detection sensor is output to the sheet feeding unit, and is used for adjusting the position of the height of the sheets by controlling the rotation of the motor for raising or lowering the sheet feeding tray.

Further, the sheet suction and conveying section provided above the sheet feeding tray has a conveying belt provided with suction holes for sucking and holding a sheet, a suction duct, and a blow out duct.

The suction duct is for sucking air via the suction holes of the conveying belt.

Further, the sheet separating section blows air at the edge parts of the sheets thereby making the sheet float up and separate, and has the role of supporting the sheet suction and conveying (see, for example, Patent Document 1).

PRIOR TECHNICAL DOCUMENTS

Patent Documents

Patent Document 1: Unexamined Japanese Patent Application Publication No. 2005-162419

SUMMARY OF THE INVENTION

Problems to be Solved by the Invention

The sheet feeding apparatus disclosed in Patent Document 1, is considered to be a useful technology in which the problems that occur when a roller is used as a sheet feeding section, for example, the problems of reduction in the sheet feeding performance due to temporal change in the roller material, change in the external diameter due to wear, or due to changes in the friction coefficient of the roller surface.

However, the sheet feeding apparatus disclosed in Patent Document 1, does not consider the use of sheets with small sizes, in particular, the use of sheets that are not only small in size but also are of large weight (for example, a "thick sheet" with a width of 100 mm×length of 148 mm) for equivalently about 3.94 in×5.83 in).

It in a sheet feeding apparatus disclosed in Patent Document 1, a sheet with a small size and also a large weight is used, it is possible to consider that the following problems occur.

For example, in the sheet feeding apparatus, the above height detection sensor and the height detection sensor lever are provided at a position corresponding to the rear end part of the sheet feeding tray, and the configuration is such that the height detection sensor lever mechanically comes into contact with the rear edge part of the sheet.

On the other hand, the duct for blowing air at the edge surface of the sheet causing it to float up and separate is provided at the leading edge side of the sheet.

In this manner, the construction of blowing air for separating the front edge of the sheet while pressing down the rear end of the sheet is an indispensable requirement for causing the sheet to float up and separate.

In this type of construction, for example, in particular, a sheet that is small in size and also thick is used, since the distance between the pressing and contacting part of the height detection sensor lever and the duct for separation is short, there is the fear that it is difficult to make the sheet float up.

Further, if the air is made strong for making the sheet float up, there is the possibility that even the rear edge part of the sheet and the height detection sensor lever will be caused to float up.

If this happens, it becomes impossible to make the height detection sensor lever operate according to the position of the height of the sheet, and as a result, there will be problems in the sheet top surface position control for which the condition is that the height detection sensor lever operates according to the position of the height of the sheet.

The present invention was made considering the above points, and a main object of the present invention is to provide a sheet feeding apparatus that makes it possible to feed sheets in a stable manner and with a simple configuration of the control of the position of the top surface of the sheet, even when a sheet that is small in size and that is also thick is used.

Means for Solving the Problems

The present invention can be achieved according to the following configuration requirements.

(1) A sheet feeding apparatus with the feature that, it has, a sheet loading section having a raising and lowering plate that can be raised or lowered after stacking sheets;

a sheet side surface regulating member that regulates the side surface of the sheets stacked in said sheet loading section;

an air blowing section that blows air towards the side surface of the sheets in the top part among the sheets stored in said sheet loading section;

a sheet suction and conveying section that is installed above said sheet loading section, and having a gap with the topmost sheet in the sheets stored in said sheet loading section;

a reflection type sensor pointed towards the side surface of the sheets in the stacked state and stored in said sheet loading section; and a control section that carries out control so that said raising and lowering plate is raised when, the output light of said reflection type sensor passes straight in the gap between the sheet that is made to float up by air flow that is blown out by said air blowing section, and does not return to the light receiving section of said reflection type sensor.

(2) A sheet feeding apparatus according to (1) above with the feature that, said reflection type sensor is provided on said sheet side surface regulating member.

(3) A sheet feeding apparatus according to (1) above with the feature that, said sheet side surface regulating member can move in a direction at right angles to the direction of conveying the sheet by said sheet suction and conveying section.

(4) An image forming apparatus with the feature that, it has, a sheet feeding apparatus with the feature that, it has, a sheet loading section having a raising and lowering plate that can be raised or lowered after stacking sheets, a sheet side surface regulating member that regulates the side surface of the sheets stacked in said sheet loading section, an air blowing section that blows air towards the side surface of the sheets in the top part among the sheets stored in said sheet loading section, a sheet suction and conveying section that is installed above said sheet loading section, and having a gap with the topmost sheet in the sheets stored in said sheet loading section, a reflection type sensor pointed towards the side surface of the sheets in the stacked state and stored in said sheet loading section, and a control section that carries out control so that said raising and lowering plate is raised when, the output light of said reflection type sensor passes straight in the gap between the sheet that is made to float up by air flow that is blown out by said air blowing section, and does not return to the light receiving section of said reflection type sensor, and an image forming section that forms toner images on an image carrier and transfers said toner image onto a sheet fed from said sheet feeding apparatus.

Effect of the Invention

With the construction of (1) above, since the sensor that detects the upper limit position of sheets is made a reflection type sensor, and since the factors suppressing the behavior of sheets are eliminated, it is possible to easily put a sheet in the floating state, even if it is a small sized sheet, or a small sized and also a thick sheet.

Further, since the construction is one in which the raising and lowering plate is raised via the control section when the output of the reflection type sensor becomes an output indicating that it is between a sheet that is in the floating state and the sheets that are maintained in the stacked state, the construction is simple compared to mechanical type sensors, and the control of the upper limit position of the sheets can be easily made.

Putting it in other words, since it is possible to provide the reflection type sensor at a height position at which it is possible to detect the position between a sheet that is in the floating state and the sheets that are maintained in the stacked state, for example, on a static member, and also, since it can be provided in a condition not contacting the sheets, even the risk of failure is low.

In the construction of (2) above, since the already installed sheet side surface regulating member is used, the construction can be made simpler.

In the construction of (3) above, since it is possible to accept sheets of different sizes, the freedom of use of the sheet loading section is enhanced.

In the construction of (4) above, since the merits described for (1) to (3) above can be utilized, it is possible to maintain the compactness of the entire image forming apparatus.

DETAILED DESCRIPTION OF THE PREFERRED EMBODIMENT

Some preferred embodiments of the present invention are described in the following with reference to the drawings.

Figure 1:
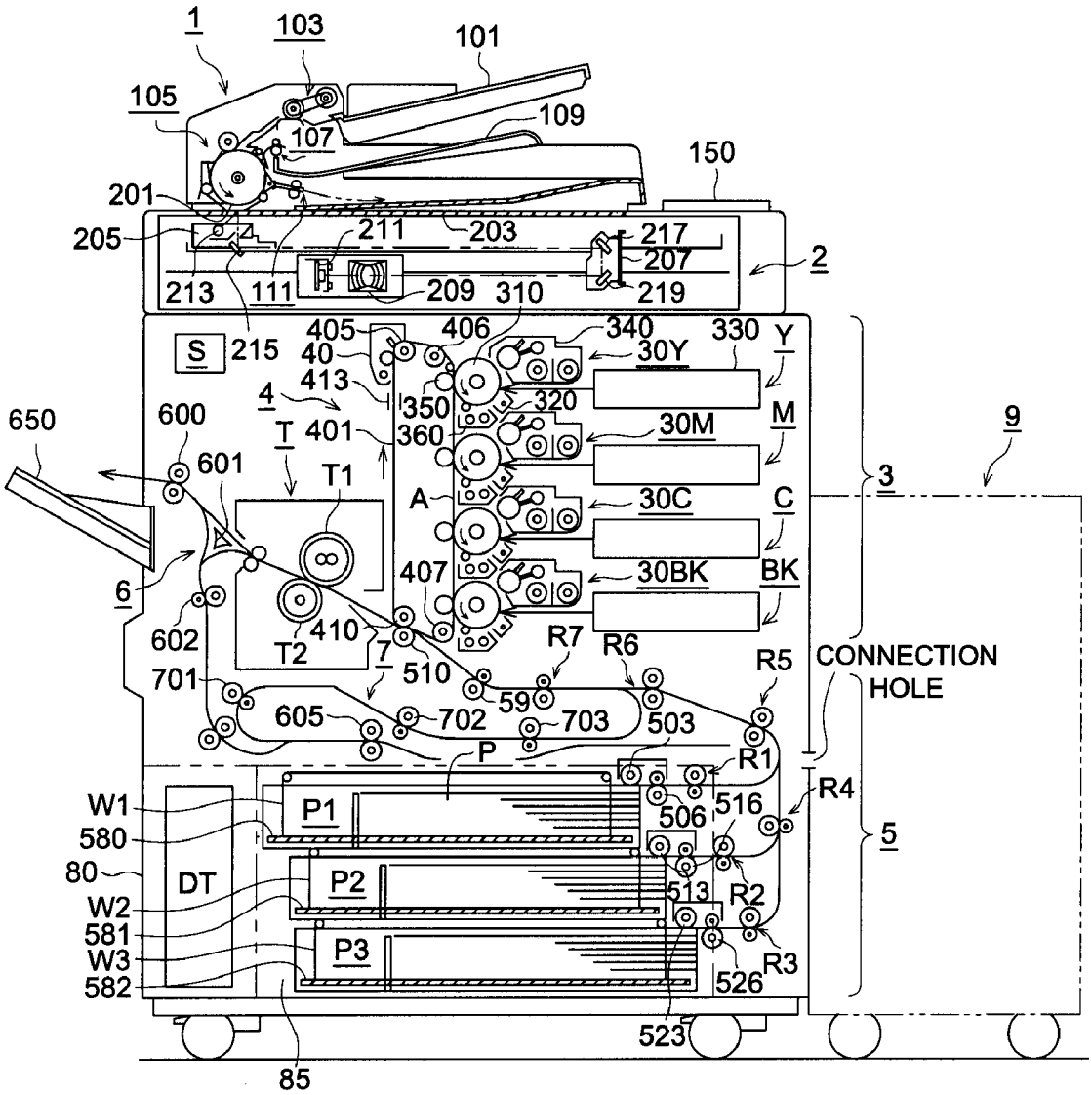
FIG. 1 is a schematic diagram showing the construction of an image forming apparatus that is a digital color copying machine.

FIG. 1 is a schematic diagram showing the construction of an image forming apparatus that is a digital color copying machine.

The image forming apparatus (for the sake of convenience, may also be called the image forming apparatus main unit) shown in the figure has an automatic document feeding apparatus 1 at the top part of the main unit of the apparatus, and has on the inside, an image reading section 2, an image forming section 3, a belt installation section for a belt unit 4, a sheet feeding section 5, a fixing device T, an inverting and re-feeding section 6, and ADU 7 which is an inverting conveying section.

The automatic document feeding apparatus 1 is an apparatus that issues one sheet at a time of the original document and conveys it to the image reading position, and discharges a document whose image reading has been completed to a prescribed place.

The automatic document feeding apparatus 1 has a document placement table 101, a document separating section 103, a document conveying section 105, a document discharging section 107, a document discharging tray 109, and, in the both sides copying mode, a document inverting section 111 made up of a roller pair for reversing the top and bottom surfaces of the document.

A document (not shown in the figure) having a plurality of sheets and placed on the document placement table 101 is separated into one sheet at a time by the document separating section 103, and is conveyed towards the image reading position via the document conveying section 105.

The document reading position is provided on the downward side of the document conveying section 105, and at that position, through a slit 201 constituting an image reading section 2, the images of the document are read out, the read out document is discharged by the document discharging section 107 to above the document discharging fray 109.

Further, in the both sides copying mode, a document that is conveyed after its one side has been read out is conveyed by the document inverting section 111 in the direction of the arrow of the double dot broken line.

Further, after the drive is stopped in the condition in which the rear end of the document in the direction of conveying is being gripped, due to the rotation in the reverse direction of the document inverting section 111, after the document is guided again via the document conveying section 105 to the image reading position, the document is discharged by the document discharging section 107 to above the document discharging tray 109.

The above process is repeated for a number of times equal to the number of document sheets placed on the document placement table 101.

The image reading section 2 has a slit 201, a first mirror unit 205 which integrates a lamp 213 for illuminating the document and a first minor 215 for reflecting the light reflected from the document, and a second mirror unit 207 which integrates a second mirror 217 and a third mirror 219.

Further, it has an imaging lens 209 that forms an image on the imaging element from the light reflected from the third mirror 219, and a line shaped imaging element 211 (hereinafter, referred to as CCD) that carries out photoelectric conversion of the optical image formed by the imaging lens 209 and obtains image information.

The image information, after being subjected to the appropriate image processing, is temporarily, accumulated in the memory inside the control section S to be described later.

In the form of reading out in the image reading section 2 a document fed by an automatic document feeding apparatus 1, the first mirror unit 205 and the second minor unit 207 are fixed at the positions shown in the figure.

The image information of different colors read out by the image reading section 2, is successively read out from the memory, and is input as respective electrical signals to the exposure optical system of each color which are electrostatic latent image forming sections.

The image forming section 3, has four sets of image forming units 30 of yellow (Y), magenta (M), cyan (C), and black (BK) (30Y, 30M, 30C, and 30BK: hereinafter referred to as image forming units) that form toner images corresponding to a color separated image.

Each of the different image forming units 30, has a photoreceptor drum 310 as an image carrier which is a drum shaped metal base on which is present a photosensitive layer, a charging unit 320, an exposure optical system 330 which is an image writing section, a developing unit 340, a transfer section 350, and a cleaning section 360 as its main constituent elements.

Further, the exposure optical system 330 is an exposure unit constituted by a laser optical system.

In the figure, reference numbers have been assigned only for the members constituting the image forming unit of the color yellow, and since the other image forming units have basically the same construction, the reference symbols have been omitted from the point of view of simplifying the drawings.

The developing unit 340 stores a two component developing agent that has a magnetic carrier (hereinafter referred to merely as a carrier) and a non-magnetic toner (hereinafter referred to merely as a toner).

Further, the developing unit 340, has a rotatable and also non-magnetic cylindrical shaped developing agent carrier (hereinafter referred to as a developing sleeve, or merely as a sleeve) that has incorporated inside it a plurality of magnets (magnetic poles) at fixed positions along the circumferential direction, and a toner density detection section (not shown in the figure).

The plurality of magnets are arranged so that the developing agent is magnetically attracted and adhered on the sleeve, conveyed to the developing region due to the rotation of the sleeve, subsequently, the developing agent after the developing process is automatically removed from on top of the sleeve utilizing a repelling magnetic field.

Further, although a bias voltage with a prescribed polarity (here, an AC voltage superimposed on a negative polarity DC voltage) is applied to the developing sleeve in the developing unit 340 during the image forming operations, since the constructions themselves of these are well known, their detailed explanations will be omitted here.

In addition, related to each developing unit 340 is provided a toner supplying device, and this toner supplying device has a toner bottle mounting section in which is mounted in a rotatable manner a toner bottle filled with replenishing toner of different colors, and a toner storage chamber that can accumulate the toner discharged from the toner bottle.

Further, the transfer section 350, although is made of a roller opposite to a part of the circumference of the photoreceptor drum 310 via an intermediate image transfer belt 401 described later, it is also possible to configure it in the form normally called a transfer electrode that has an electrode made of a discharging wire.

The cleaning section 360 removes the toner remaining on said photoreceptor drum 310 after transfer, the removed toner is lowered through an appropriate pipe (not shown in the figure), and is stored in the waste toner box DT installed by the side of the sheet trays.

The different image forming units 30, are arranged in the sequence from above of yellow (Y), magenta (M), cyan (C), and black (BK) on one flat surface A (the tense surface) along the forward direction of movement of the loop shaped intermediate image transfer belt 401 constituting a belt unit 4.

The intermediate image transfer belt 401, the supporting rollers 405, 406, 407, and the back up roller 410, etc., that support in a rotatable manner the intermediate image transfer belt 401 constitute the belt unit 4.

Further, the back up roller 410 constitutes a secondary transfer section along with a transfer roller 510 placed opposite to it so that it rotates while pressing against the back up roller 410 with the intermediate image transfer belt 401 in between them.

The image formation using the configuration of the above image forming units 30 and the belt unit 4 is carried out as follows.

Along with the starting of the image forming process, the surface of the photoreceptor drum 310 rotating in the counterclockwise direction is charged to a prescribed polarity (negative polarity here) by the charging unit 320.

Next, exposure is made corresponding to the first color signal of the exposure optical system 330, that is, corresponding to the image signal of yellow (Y), and a latent image corresponding to the image of yellow (Y) is formed on the photoreceptor drum 310.

After said latent image is converted by negative development, due to a contacting or non-contacting development process by the developing agent of the developing unit 340, into a yellow toner image, it is transferred on to the intermediate image transfer belt 401 due to the operation of the transfer section 350.

The image formation due to the other color signals started successively after prescribed time intervals after starting the image formation due to the first color signal is carried out by each of the image forming units 30 of the colors magenta (M), cyan (C), and black (BK) by processes similar to the above.

The different toner images formed on the photoreceptor drums by the respective image forming units are transferred successively so as to be placed in the image area where said toner image of the yellow (Y) color is present, and a superimposed color toner image is formed on the intermediate image transfer belt 401.

On the other hand, the surfaces of said photoreceptor drums 310 after completion of the transfer process are cleaned by the cleaning sections 360, and preparations are made for new image formation.

Further, the timings for starting the individual image formation process for the photoreceptor drums 310, or the intermediate image transfer belt 401 are carried out as follows.

In other words, a registration sensor 413 is installed in the segment from the position where the transfer roller 510 is present up to the position where the first set (yellow) image forming unit is provided on the outside of the intermediate image transfer belt 401 and in the direction of rotation of the intermediate image transfer belt.

Further, time is calculated taking as the starting point when the reference mark provided on the intermediate image transfer belt 401 is detected by the registration sensor 413, and after the elapse of every prescribed interval of time, successively, the processes related to yellow (Y), magenta (M), cyan (C), and black (BK) are started.

Further, the reference symbol S is a control section including a computer, which includes a program for operating the machine, and carries out all the controls such as the controls related to the sequence of image forming processes, sheet feeding control, toner density control, etc.

Putting it in other words, the control section S has a CPU that carries out computation control processing, a ROM that stores various operation programs, a RAM that stores the computation results, etc.

Further, not only the outputs of various sensors are input to said CPU via interfaces, but also, based on that information, there is the configuration of carrying out the drive controls of various types of motors or display sections, etc.

The reference symbols P1, P2, and P3 refer to three sheet trays installed at the lower part of the apparatus main unit, and can be taken out (pulled out) in a direction towards the front in the figure.

On the inside of the sheet trays P1, P2, and P3 are provided the raising and lowering plates 580, 581, and 582 for placing the sheets on them.

The raising and lowering plates 580, 581, and 582 are raised or lowered by a raising and lowering plates driving section (lift mechanism) having wires W1, W2, and W3 fixed to one part of the raising and lowering plates, pulleys (no reference symbols) for passing the wires over, motors (not shown in the figure) for providing driving force to the main driving shafts having the pulleys, etc.

DT is a waste toner box as described earlier, which is by the side of the sheet trays P1, P2, and P3, and can be taken out (pulled out) in the same direction as the sheet trays.

The double dotted line enclosing the waste toner box DT and the sheet trays P1, P2, and P3, indicates the outer door 80 that covers the front of the storing section of the waste toner box DT and the front panel door 85 that covers the front of the sheet trays.

In the feeding sections of the sheet trays P1, P2, and P3, are provided the sheet feeding rollers 503, 513, 523, and the separating rollers 506, 516, 526, and the conveying rollers R1, R2, and R2, and the sheet P that is issued by these rollers is conveyed along the conveying path in which R4 to R7 are installed.

The reference symbol 59 refers to the registration roller, which is more towards the downstream side than the conveying roller R7, and is provided at a position close to the secondary transfer section.

The item that is along the conveying path and that is installed towards the downstream side of the secondary transfer section (the position where the transfer roller 510 is present) is the fixing unit T which has as its main elements a first fixing roller T1 with a built in heat source, and a second fixing roller T2 that rotates in pressing contact with the first fixing roller.

The reference symbol 600 indicates a sheet discharging roller, and 650 indicates a sheet discharge tray that stacks and stores the discharged sheets.

The form of the sheet conveying path and the conveying control related to the inverting sheet discharging and re-feeding section 6 and the ADU 7 are well known, and since they are not directly related to the present invention, their description will be omitted here.

Next, the processes from the color toner image formed on the intermediate image transfer belt 401 is transferred onto a sheet P until the sheet is discharged to outside the apparatus are explained briefly including the apparatus configurations that have not been explained so far.

At an appropriate timing corresponding to the image formation on the intermediate image transfer belt 401, the sheet P is issued by the sheet feeding rollers 503 (513, 523).

Next, the sheet P is conveyed towards the registration roller 59 provided at a position just before the transfer section (transfer region) while being gripped and conveyed by the separation roller 506 and a plurality of conveying rollers R1 to R7 provided on the conveying path.

The fed sheet P is a sheet material of the size specified or selected in the operation and display section 150 in which it is possible to set the number of sheets to be recorded, the recording start button, or the recording magnification ratio, or the image density, etc.

The sheet P, after its leading edge abuts against the registration roller 59, due to the restarting or rotation of the registration roller 59, is fed again at a timing so as to overlap the color toner image on the intermediate image transfer belt 401.

Next, the sheet P is pressed and gripped along with the intermediate image transfer belt by the back up roller 410 and the transfer roller 510 in the secondary transfer section, and during this period, the color toner image on the intermediate image transfer belt 401 is transferred onto the sheet P.

At the time of transferring, it is desirable to configure so that an appropriate transfer bias voltage is applied to the transfer roller 510.

The sheet P with the toner image transferred onto to it is separated from the intermediate image transfer belt 401, conveyed towards the fixing unit T by a conveying belt (not shown in the figure), the toner is melted by being heated and pressed, and is fixed onto the sheet P.

The sheet P after completion of the fixing process by the fixing unit T is conveyed by the sheet discharging roller 600 provided on its downstream side, and is discharged to the sheet discharge tray 650 provided outside the apparatus main unit.

On the other hand, the surface of the intermediate image transfer belt 401 is cleaned by the cleaning section 40, and preparations are made for carrying a new toner image.

Further, in the figure, the position shown in the figure of the path selection member 601 is the position in the case in which the sheet P is discharged after fixing processing without inverting it.

At the time of inverting discharge of the sheet, the path selection member 601 is swung by a prescribed amount, and the sheet P after fixing is guided downward along the right side of the path selection member 601.

Next, after the state is achieved in which the trailing edge is gripped by the rollers 602, due to the reverse rotation of the roller pair 602 at the back, the sheet P is raised along the left side of the path selection member 601, and is discharged via the sheet discharging roller 600.

In addition, in the case of the double side copying mode using the ADU 7, a sheet P with image formed on one side and after fixing operation is guided downward along the right side of the path selection member 601, and the conveying is stopped in the state in which the trailing edge is gripped by the roller pair 605.

Next, the roller pair 605 is rotated in the reverse direction, raised along the guide plate (not shown in the figure), guided to the ADU 7 having a plurality of roller pairs 701, 702, and 703, and the inverting of the sheet P is achieved.

The image forming process on the second surface of the sheet P is basically the same as that described earlier, and further, the discharging path after being fed out from the fixing unit T is selected from those described above.

Further, in the image forming process described above, the density of the toner in the developing agent is detected by the toner density detection sensor, its output information is entered into and computed by the control section S, and is compared with the set threshold value.

Next, if the control section S judges that toner replenishment is required, the toner conveying section is driven based on the instruction from the control section S, and the necessary amount of toner is supplied into the developing unit 340.

On the other hand, the toner removed from above the photoreceptor drum by the cleaning section 360 is sent to the waste toner box DT and is stored there.

Further, the reference symbol 9 refers to the optional sheet feeding apparatus which has incorporated in it a sheet feeding apparatus according to the present invention, and the optional sheet feeding apparatus 9 is supplied for use after integrally joining with the image forming apparatus main unit (the details of the construction of the optional sheet feeding apparatus are described later).

The sheet fed by the sheet feeding section from the sheet loading section inside the optional sheet feeding apparatus 9 is conveyed by the appropriate conveying rollers, via the connection opening, fed inside the image forming apparatus, conveying control is carried out similar to the sheet described above, and after image formation on the prescribed surface, the sheet is discharged to above the sheet discharge tray 650.

Further, in the present invention, not only an image forming apparatus main unit with built in sheet feeding apparatus but also the form of an apparatus joined with an external optional sheet feeding apparatus 9 as described above belongs to the category of an image forming apparatus.

Figure 2:
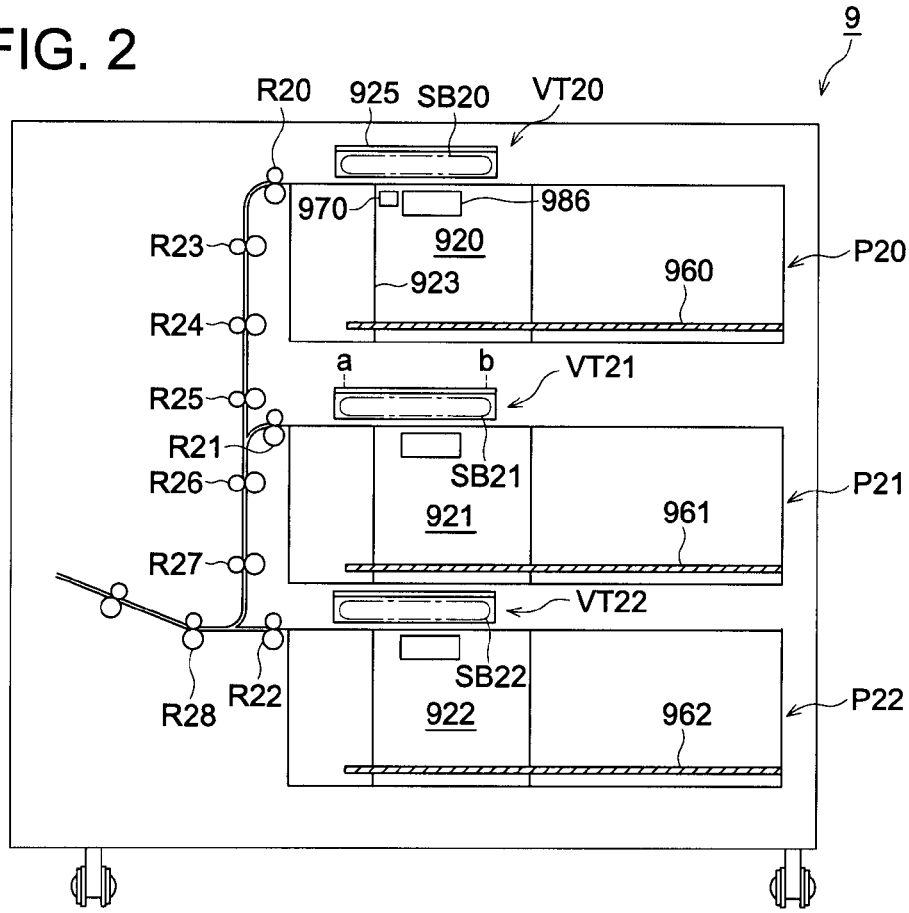
FIG. 2 is a schematic diagram for explaining the configuration within an optional sheet feeding apparatus 9.

FIG. 2 is a schematic diagram for explaining the configuration within an optional sheet feeding apparatus 9 according to the present invention.

In FIG. 2, inside the optional sheet feeding apparatus 9 are provided box shaped sheet loading sections P20, P21, and P22 in the up-down direction.

Further, above the respective sheet loading sections, at a position towards the front including the leading edge part of the sheets, are provided the sheet sucking and conveying sections VT20, VT21, and VT22 that have endless shaped suction belts SB20, SB21, and SB22 which are sheet feeding sections.

The sheet loading sections P20, P21, and P22 not only have capacities for storing large quantities of sheets P, but also are provided with the raising and lowering plates 960, 961, and 962, and further, they are provided so that they can be pulled out to the front in the figure including these raising and lowering plates.

Further, the raising and lowering plates 960, 961, and 962 are controlled so that they are raised appropriately when the stacked sheets decrease after being used for image formation, and the position of the top surface of the stacked sheets is roughly a constant position.

The raising and lowering plates 960, 961, and 962, for example, similar to the raising and lowering plates 580, 581, and 582 of FIG. 1, are driven to be raised, raising stopped, or lowered by a raising and lowering plates driving section (lift mechanism) having wires, pulleys for passing the wires over, a driving source having a motor, etc.

The regulation of the position of the sheets in the height direction can be carried out by the control section S judging the change in the output of the sensor (described later) that detects the sheet at the top, and by raising the raising and lowering plates 960, 961, and 962 according to the need, and a widely known technology can be used for the raising and lowering mechanism.

Although detailed explanations of the raising and lowering mechanism related to the raising and lowering plates 960, 961, and 962 are omitted here from the point of view that it does not characterize the present invention, for example, it is possible to refer to Unexamined Japanese Patent Application Publication No. 2006-027797.

A gap is formed between the lowermost surface of the suction belts SB20, SB21, and SB22 (this is the sheet conveying surface in the meaning of the position of the underside surface within a parallel plane, and also, the surface opposite to the top surface of the stored sheets) and the topmost sheet among the stacked sheets P.

In the present preferred embodiment, although said gap is taken as about 10 mm (or equivalently about 0.394 in), this value can be varied depending on various conditions, and does not regulate the present invention.

Here, including the construction that has not yet been explained, an explanation of the conveying path of the sheet P becomes as follows.

The direction of sheet feeding of the sheet P by the suction belts SB20, SB21, and SB22 is a direction at right angles to the direction of pulling out the sheet loading section P20 (the direction towards the left in the figure).

The sheet P fed by the suction belt SB20, at the left part in the figure, is gripped and held by a conveying roller R20 having a nip section at roughly the same height position as the bottommost surface of the suction belt SB20.

After that, not only is it conveyed by the conveying roller R20, but also, its orientation is changed downwards due to the action of the guide plate (no reference symbol).

Next, it is conveyed downwards by the conveying rollers R23, R24, R25, R26, and R27 provided in the vertical direction, after being guided on the left side in the figure of the guide plate (no reference symbol), the sheet stops after its leading edge is abutted against a conveying roller R28 whose rotation has stopped.

The conveying roller R28 carries out the function of a registration roller for adjusting the timing with the image forming process.

After that, along with the starting of rotations of the conveying roller R28, etc. the sheet P is fed into the image forming apparatus. These sheet feeding controls can be carried out by the control section S described earlier.

In a similar manner, the sheet P fed from the sheet loading section P21 by the suction belt SB21, at the left part in the figure, is gripped, held, and conveyed by a conveying roller R21 having a nip section at roughly the same height position as the bottommost surface of the suction belt SB21.

After that, it not only receives the action of the guide plate, but also, it is conveyed downwards by the conveying rollers R26 and R27, stops in the condition in which its leading edge abuts against the conveying roller R28, and is fed inside the image forming apparatus due to the starting of the rotations of the roller R28.

In addition, the sheet P fed from the sheet loading section P22 by the suction belt SB22, at the left part in the figure, is gripped, held, and conveyed by a conveying roller R22 having a nip section at roughly the same height position as the bottommost surface of the suction belt SB22.

After that, it stops in the condition in which its leading edge abuts against the conveying roller R28 which is at roughly the same height position, and is fed inside the image forming apparatus due to the starting of the rotations of the roller R28

Here, the construction of the sheet suction and conveying section is explained in concrete terms.

Figure 3:
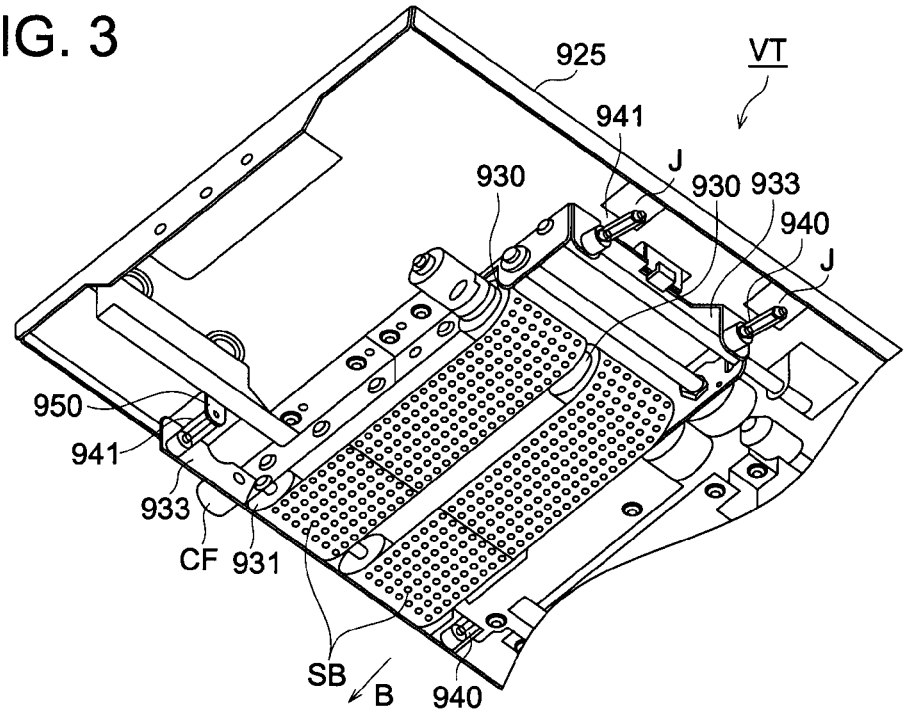
FIG. 3 is a diagram showing the main parts of the basic configuration of a suction and conveying section.

FIG. 3 is a diagram showing the main parts of the basic configuration of the suction and conveying sections VT20, VT21, and VT22, and is a partial diagram as viewed from below.

In the figure, the belt supporting member 925 is made of a plate material, fixed by screws to a fixed part of the optional sheet feeding apparatus 9, and supports the suction belt SB20 (in the following, when there is no need to specifically identify a suction belt, it will be merely referred to as the suction belt SB) in the suspended state via the suction belt supporting frame 933.

The suction belt SB has a construction of two belts placed in parallel and with a plurality of holes formed in them, and is rotated by passing over a driving roller 930 and a slave roller 931.

The suction belts SB are provided with reference to the center, and the size of the suction belt SB in the width direction and in the sheet feeding direction can be determined appropriately according to the specifications.

The size of the suction belt SB in the present preferred embodiment was taken as 90 mm (or equivalently about 3.54 in) in the width direction and 110 mm (or equivalently about 4.33 in) in the length direction.

Further, the minimum size that can be used in the present preferred embodiment is the size (100 mm×148 mm) for equivalently about 3.94 in×5.83 in) according to the specifications of vertical feeding (the form of sheet feeding in which the longer side of the sheet is parallel to the sheet feeding direction), and the maximum size that can be used is the standard size of the vertical feeding specifications (width of 330 mm×length of 487 mm) for equivalently about 12.99 in×19.17 in).

Further, the sheets are of weights in the range of 64 g/m$^2$ to 350 g/m$^2$ for equivalently 17.02 lb to 93.09 lb assuming sheet size is 17 in×22 in/500).

In the internal space part formed by the suction belt SB, a negative pressure source, for example, a duct box (see FIG. 5) is placed so that is connected to a casing with a built in sirocco fan F1 (not shown in the figure: in the following, this may be referred to as a negative pressure source F1).

Further, shafts (pins) J are embedded at four locations in the suction belt supporting frame 933, and anus 940 and 941 are provided in a condition in which one of their ends mates freely with said shafts J.

The other ends of the arms 940 and 941 are provided in the freely mating condition with the shafts J provided on the bent section 950 formed in the belt supporting member 925.

With the above construction, the shafts J in the bent section 950 function as a pivot for swinging when the position is moved of the suction belt SB or of the suction belt supporting frame 933.

Continuing the explanations returning to FIG. 2, the sheet loading sections P20, P21, and P22 are provided in a direction at right angles to the sheet feeding direction, and have sheet side surface regulating members (hereinafter referred to merely as side surface regulating members) 920, 921, and 922 for regulating the side surfaces of the sheets.

Each pair of the side surface regulating members 920, 921, and 922, when viewed from above in the figure, is placed in opposing positions with the suction belts SB20, SB21, and SB22 in between them.

Further, the side surface regulating members 920, 921, and 922 are constituted so that their positions can be moved and fixed in a direction at right angles to the direction of sheet feeding so that it is possible to comply with sheets P of all various sizes.

The reference symbol 923 in FIG. 2 refers to the left end position of the side surface regulating members 920, 921, and 922, and the front wall (described later) of the guide member that regulates the leading edge of the sheet P is provided slightly separated from this position and in a surface at right angles to the sheet P.

The position of the front wall of the guide member is also within the suction area of the suction belts SB20, SB21, and SB22, and close to one of its ends.

Further, the trailing edge regulating member that regulates the trailing edge of the sheet, according to the need, can be provided so that it can be moved linearly in the direction of sheet feeding and so that its position can be fixed.

The reference number 986 in FIG. 2 refers to the air blowing outlet formed on the inside of the side surface regulating member 920, and this air blowing outlet is related to the air blowing section described later.

The position in the height direction of the air blowing outlet 986, or its orientation, etc., are constituted so that the sheet P at the topmost position or a plurality of sheets including the sheet at the topmost position among the sheets stored in the sheet loading section P20 (P21, P22) can be put in the floating state.

Further, the air blowing outlet 986 is present more towards the leading edge side of the sheets than the central part of the sheets in the direction of sheet feeding, and also, within the region a-b in the sheet feeding direction in which the suction belt SB has been placed.

In FIG. 2, 970 is a reflection type sensor that has a light emitting section and a light receiving section integrally, and is installed on the side surface regulating member so as to be positioned on the downstream side of the air blowing outlet 986 in the direction of sheet feeding. As a reflection type sensor, for example, it is possible to use the reflection type photosensor (GP2A25J000F) manufactured by Sharp Corporation.

Since the air bowing outlet 986 and the reflection type sensor 970 are provided in all sheet loading sections, their duplicate explanations will be omitted.

The output of the reflection type sensor 970 is used for regulating the upper limit position of the sheets P stacked on the raising and lowering plate 960 (961, 962).

Basically, the output of the reflection type sensor 970 is taken in to the control section S, and, for example, if it is judged by the control section S that the change in its output prompts the raising of the raising and lowering plate, the raising and lowering plate driving section is driven and the raising and lowering plate is raised.

Further, when the output of the reflection type sensor 970 becomes so that a sheet P is detected, the control section S stops the drive of the raising and lowering plate driving section and stops the raising of the raising and lowering plate.

The drive control of the raising and lowering plate described above, can be controlled using the conventional technology, for example, by converting the output of the reflection type sensor 970 into a voltage value and comparing it with a comparison reference voltage.

Further, while the details are described later, the position of the reflection type sensor 970 in the height direction, is a position at which it is possible to detect between the sheet P that is in the floated up state due to the air flow from the air blowing outlet 986 and the surface of the sheets that are maintaining the stacked state without being affected by that air flow.

Putting it in other words, the construction in which, excluding the sheet that is in the floated up state, whether or not the top part sheet (including the topmost sheet) that is maintaining the stacked state is at the prescribed position is detected by the reflection type sensor 970, and it is aimed to maintain the upper limit position of the entire stack of sheets through control by the control section S of the raising and lowering plate can also be said to be a sheet feeding apparatus according to the present invention.

Figure 4:
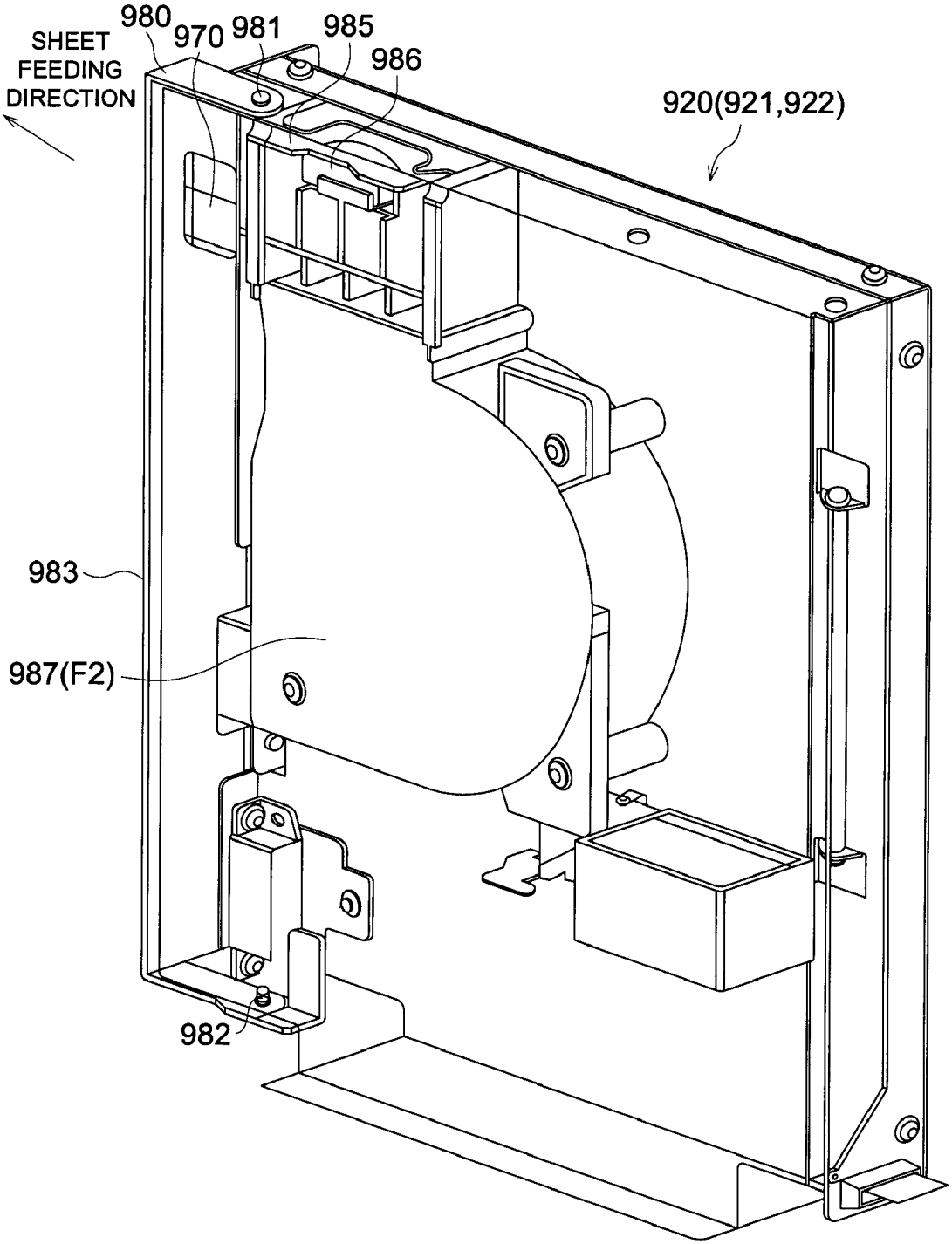
FIG. 4 is a perspective view diagram of a side surface regulating member.

Here, the construction of the side surface regulating member is explained in detail. FIG. 4 is a perspective view diagram of a side surface regulating member, and from the fact that the constructions of the left and right side surface regulating members are the same, and for the sake of convenience, only one of the pair has been shown.

The reference symbol 980 in FIG. 4 refers to the second side surface regulating member for sheets of the smallest size, and with the pins 981 and 982 embedded at the top and bottom in the first side surface regulating member 920 as the pivotal points, can occupy the retracted position shown in the figure and a position rotated by 90 degrees in the counterclockwise direction.

The side surface regulating member 980, at the position rotated by 90 degrees from the retracted position, regulates the side surface of sheets of the smallest size using the surface 983.

However, when the side surface regulating member 920 has an amount of movement with which it can regulate sheets of the smallest size, of course, it is possible to omit this.

The reference number 985 in FIG. 4 is a flap provided on the front top part of the side surface regulating member 920, and has an appropriate width and length for projecting on the top surface (side) of the stacked sheets.

At the inside wall surface (meaning the top part on the wall surface of the side surface) of the side surface regulating member 920 (921, 922) positioned immediately below the flap 985, is provided the air blowing outlet 986 described earlier.

The air blowing outlet 986 is connected to one end of a duct (no reference number), and the other end of this duct is connected to a casing 987 with a built in air blowing section F2 made of a fan.

Further, the casing 987 has a structure that is provided in the internal space formed by the inside and outside walls of the side surface regulating member.

In the above construction, when the air blowing section F2 is driven, air flow is blown out from the air blowing outlet 986, and this air flow is directed towards the side surfaces of a plurality of sheets including the topmost sheet in the sheets that were in the stacked state.

Next, the air flows between the sheets Pin the top part, and at least, not only separates the topmost sheet P from the sheets below it and also puts it in the floating state, and has the effect of aiding easy suction and conveying by the suction and conveying section.

Putting it in other words, if the suction area of the suction belt SB is small, even if the gap between the topmost sheet and the suction belt is small, for example, 1 mm for equivalently about 0.039 in), it can be difficult to make sheets larger than the prescribed size (vertical feeding of 210 mm×297 mm) for equivalently about 8.27 in ×11.69 in) get sucked by and stick to the suction belt.

The adoption of the air blowing section F2 can eliminate such problems.

Further, it is sufficient that the driving control of the air blowing section F2, basically, is carried out for types of sheets that cannot be definitely sucked and stuck to the suction belt by the negative pressure due to the negative pressure source F1, such as when using a small sized sheet that is thick (200 g/m$^2$ or more) (or equivalently about 53.19 lb or more assuming sheet size is 17 in×22 in/500), and need not necessarily be carried out for all types of sheets.

In the present preferred embodiment, the configuration is such that the strength of the air flow (air flow rate) due to the air blowing section F2 can be selected from several steps according to the sheet size information.

Figure 5:
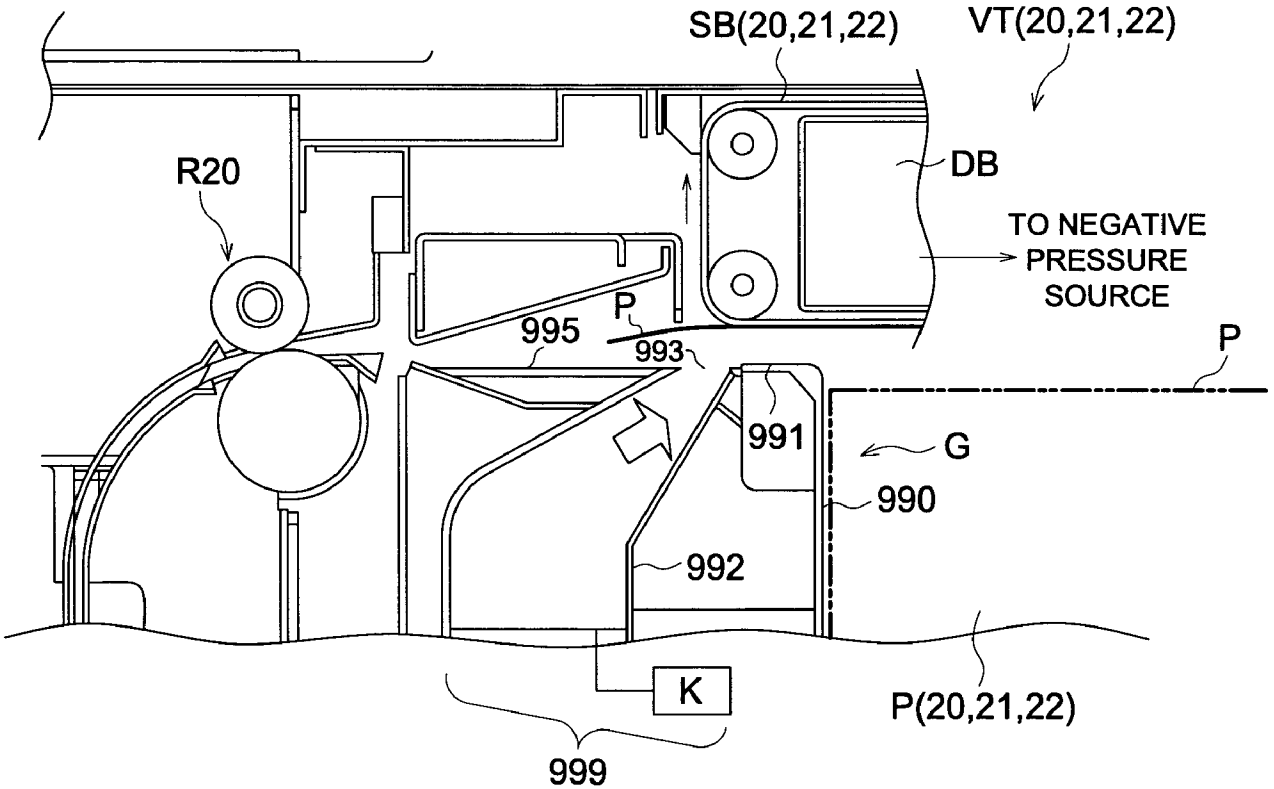
FIG. 5 is a diagram showing an enlarged view of the main parts of a sheet feeding apparatus.

Next, explanations of the construction around the sheet feeding section and explanations of the control during sheet feeding are given using FIG. 5. FIG. 5 is a diagram showing an enlarged view of the main parts of a sheet feeding apparatus.

In FIG. 5, the reference symbol DB is a duct box, and this duct box is connected to a negative pressure source.

A guide member G is provided within the installation area of the suction belt SB and below the area of the end part.

The guide member G has a front wall 990 that regulates the leading edge of the sheets and a horizontal guide surface 991 that is provided along an extension in the sheet feeding direction.

Putting it in other words, the guide surface 991 is at a downstream position that is close to the sheet loading section P, and is constructed so that it has a height position that is more than the topmost sheet stored in the sheet loading section.

The reference symbol 992 in FIG. 5 is a duct that is connected to the pressure source K made of a fan that is an air flow generation source, and has the air blowing outlet 993 at one end.

The air blowing outlet 993 is at a downstream position close to the guide surface 991, and the construction is such that it is at a slightly lower height position than the guide surface 991.

Further, the duct 992 is made narrow from the middle, and is bent in a prescribed direction.

Putting it in other words, the duct 992 is configured so that the air flow blown out from the air blowing outlet 993 can be pointed towards the downstream side end part of the guide surface 991, and towards the sheet conveying surface of the sheet suction and conveying section that is opposite the guide surface 991 (effectively the conveying surface of the suction belt).

The air flow that is forcibly directed in the directions described above, for example, for the sheet that is being sucked and conveyed by the suction belt SB, acts in a direction to push that sheet back.

The air blowing outlet 993 is provided with the center as the reference in a direction at right angles to the conveying direction of the sheet P (in the following, this direction is referred to as the sheet width direction).

The size of the air blowing outlet 993 in the sheet width direction can be determined appropriately, and for example, it is not necessary to make it as wide as the width of the sheet used.

The reference symbol 995 in FIG. 5 is a horizontal guide plate provided on the downstream side of the guide member G, and extends up to just before the conveying roller R20 while avoiding the part where the air blowing outlet 993 is present.

The operations of the different parts constituting the sheet feeding apparatus described above are explained including the control.

When a sheet feeding command is issued by the control section S for the image forming process, driving control is carried out via the driver circuits (not shown in the figure) simultaneously of the sirocco fan F1, the air blowing section F2, and the pressure source K, and after a prescribed time duration of about 1 second, the drive of the suction belt SB is started.

Within that prescribed time interval, switching on and off of the air blowing section F2 is repeated several times.

This is done, since particularly the sheet in the top part among the sheets stored in the sheet loading section are affected by humidity and can easily get stuck to each other, for eliminating that effect as much as possible, and to stabilize the separation of sheets.

After the prescribed time interval described above has passed, and until the supply of the number of sheets necessary for one image forming job has been completed, the operating states of the sirocco fan F1, the air blowing section F2, and the pressure source K are maintained.

When the suction belt SB is driven, the topmost sheet P that is put in the floated up state by the air flow from the air blowing section F2 is sucked by the suction belt SB, and is conveyed.

Next, when the leading edge of the sheet P reaches a position corresponding to the downstream side edge of the guiding surface 991, the air flow ejected from the air blowing outlet 993 hits the sheet.

However, since the suction force on the sheet via the suction belt SB is larger than the force of air flow, the conveying of the sheet P is carried out normally.

Next, at the end part where the suction belt SB changes direction from horizontal to vertical, when the suction force does no longer act on the sheet P, the leading edge of the sheet P automatically gets separated from the suction belt SB.

On the other hand, since the trialing edge of the sheet is being sucked by the suction belt SB, the sheet P is conveyed by being regulated by the horizontal guide plate 995, etc., and eventually the leading edge of the sheet gets gripped by the conveying roller R20.

When the conveying of one sheet P is completed, the drive of the suction belt SB is stopped, for example, after the elapsing of 300 milliseconds, the drive is restarted. This operation is repeated for the number of times equal to the number of sheets to be fed.

Further, along with the sheet feeding of one image forming job, when the output of the reflection type sensor becomes an output indicating that it is between a sheet that has been put in the floating state due to the air flow ejected from the air blowing section and the sheets that are maintained in the stacked state (when the output light of the reflection type sensor does not return to the light receiving section), through the control section S, the raising and lowering plate is raised.

Figure 6:
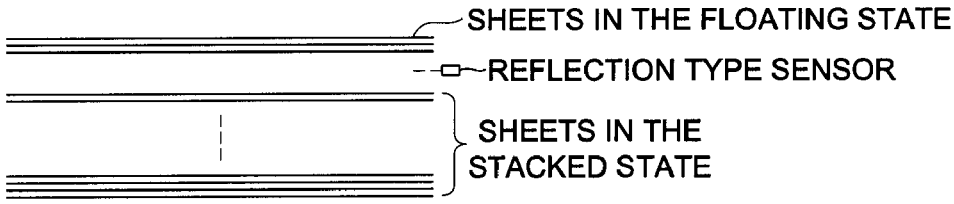
FIG. 6 is a schematic diagram showing the position state at the time of the detection.

The state at this time shown schematically as a cross-section becomes like that shown in FIG. 6.

In FIG. 6, although the light emitting section and the light receiving section of the reflection type sensor are on the same plane, it is sufficient if the prescribed purpose is met, and the degree of freedom in design is high relative to the specifications of the apparatus.

Eventually, when a sheet at the topmost part of the stacked sheets or the top part having the topmost sheet is detected by the reflection type sensor, the drive of the raising and lowering plate is stopped based on that output signal.

The amount of raising this raising and lowering plate is, for example, is the raising amount that includes the top few sheets that are put in the floating up state.

When the completion of feeding of the necessary number of sheets according to the sheet feeding command is judged by the judgment section of the control section S, via the driver circuits, the drive of the sirocco fan F1, the air blowing section F2, and the pressure source K are stopped.

Next, the sheet feeding operations based on the control described above are carried out upon receiving the next sheet feeding command.

As has been described above, in the present preferred embodiment, the raising and lowering plate is raised when the output of the reflection type sensor becomes an output indicating that it is between a sheet that has been put in the floating state due to the air flow ejected from the air blowing section and the sheets that are maintained in the stacked state.

However, the forms of the sheets in the floating state are not constant, and in some cases, they may be detected by said sensor instantaneously.

At this time, the sensor output becomes pulse shaped, and if such conditions occur several times within an extremely short time, it is likely that the drive control of the raising and lowering plate via the motor is not carried out properly.

Because of this, when such pulse shaped sheet detection outputs are given by the sensor, if the motor is forcibly driven for a prescribed period of time (for example, 100 milliseconds), it is possible to make the ease of operation better, and also to prevent wear of the motor.

In addition, the detection capacity (detection distance) of the reflection type sensor of about 25 mm to 30 mm for equivalently about 0.98 in to 1.18 in) from the surface of the side surface regulating member is advantageous from the point of view of handling, etc.

DESCRIPTION OF SYMBOLS

1 Automatic document feeding apparatus
2 Image reading section
3 Image forming section
4 Belt unit
5 Sheet feeding section
9 Optional sheet feeding apparatus
920, 921, 922 Side surface regulating member
960, 961, 962 Raising and lowering plate
970 Reflection type sensor
P21, P21, P22 Sheet loading section
SB20, SB21, SB22 Suction belt
VT20, VT21, VT22 Sheet suction and conveying section

The invention claimed is:

1. A sheet feeding apparatus comprising:

a sheet loading section including a raising and lowering plate which stacks sheets and is capable of being raised and lowered with the stacked sheets;

a sheet side surface regulating member which regulates a side surface of the sheets being stored in the sheet loading section;

an air blowing section which blows air towards a leading edge side in a conveyance direction and the side surface of the sheets in a top part among the sheets stacked in the sheet loading section;

a sheet suction and conveying section which is installed above the sheet loading section, having a gap with a topmost sheet in the sheets stacked in the sheet loading section and sucks and conveys the topmost sheet;

a reflection sensor arranged at the leading edge side in the conveyance direction and the side surface of the sheets, the reflection sensor pointing towards the side surface of the sheets in a stacked state and stored in the sheet loading section; and a control section which carries out control so that the raising and lowering plate is raised in a case when the reflection sensor does not detect sheets in a stacked condition under the topmost sheet, and the raising of the raising and lowering plate is stopped in a case when the reflection sensor detects the sheets in the stacked condition under the topmost sheet while the topmost sheet is in a floated up state caused by an air flow that is blown out by the air blowing section.

2. The sheet feeding apparatus described in claim 1, wherein the reflection sensor is provided on the sheet side surface regulating member.

3. The sheet feeding apparatus described in claim 1, the sheet side surface regulating member is capable of moving in a direction perpendicular to a direction of conveying sheets by the sheet suction and conveying section.

4. An image forming apparatus, comprising:

a sheet feeding apparatus comprising:

a sheet loading section including a raising and lowering plate which stacks sheets and is capable of being raised and lowered with the stacked sheets;

a sheet side surface regulating member which regulates a side surface of the sheets being stored in the sheet loading section;

an air blowing section which blows air towards a side near a leading edge in a conveyance direction and the side surface of the sheets in a top part among the sheets stored stacked in the sheet loading section;

a sheet suction and conveying section which is installed above the sheet loading section, having a gap with a topmost sheet in the sheets stacked in the sheet loading section and sucks and conveys the topmost sheet;

a reflection sensor arranged at a side near a leading edge in the conveyance direction and near the side surface of the sheets, the reflection sensor pointing towards the side surface of the sheets in a stacked state and stored in the sheet loading section; and a control section which carries out control so that the raising and lowering plate is raised in a case when, after top sheets are in a floated up state caused by an air flow blown out by the air blowing section, the reflection sensor does not detect next sheets in a stacked condition, and raising the raising and lowering plate is stopped in a case when, after the top sheets are in the floated up state caused by the air flow, the reflection sensor detects the next sheets in the stacked condition; and and an image forming section which forms toner images on an image carrier and transfers the toner image onto a sheet fed from the sheet feeding apparatus.

* * * * *